United States Patent [19]

Widmer

[11] 3,958,843

[45] May 25, 1976

[54] SPINNING SPINDLE ASSEMBLY

[75] Inventor: Dieter Widmer, Uerikon, Zurich, Switzerland

[73] Assignee: Spindel-Motoren-und Maschinenfabrik A.G., Uster, Switzerland

[22] Filed: Sept. 13, 1974

[21] Appl. No.: 505,641

[30] Foreign Application Priority Data

Sept. 28, 1973 Germany ..... 2348908

[52] U.S. Cl. ..... 308/152; 308/156; 308/228; 308/229

[51] Int. Cl.[2] ..... F16C 17/08; F16C 23/08; F16C 27/08; F16C 35/12

[58] Field of Search ..... 308/10, 149, 156, 228, 308/229, 152

[56] References Cited

UNITED STATES PATENTS

| | | | |
|---|---|---|---|
| 1,061,267 | 5/1913 | Chapman | 308/228 |
| 1,072,573 | 9/1913 | Chapman | 308/228 |
| 2,285,681 | 6/1942 | Rushing | 308/152 |
| 2,750,239 | 6/1956 | Rogner et al. | 308/228 |
| 2,777,739 | 1/1957 | Beerli | 308/228 X |
| 3,485,029 | 12/1969 | Beerli | 308/152 X |
| 3,508,800 | 4/1970 | Beerli | 308/152 |
| 3,673,783 | 7/1972 | Timbie | 308/152 X |
| 3,749,462 | 7/1973 | Wendel | 308/228 |

FOREIGN PATENTS OR APPLICATIONS

| | | | |
|---|---|---|---|
| 604,869 | 2/1926 | France | 308/238 |
| 1,025,761 | 3/1958 | Germany | 308/10 |
| 266,066 | 4/1950 | Switzerland | 308/152 |
| 509,430 | 8/1971 | Switzerland | 308/152 |
| 1,025,767 | 8/1958 | Germany | 308/152 |

*Primary Examiner*—Robert J. Spar
*Assistant Examiner*—Howard Beltran

[57] ABSTRACT

A spinning or plying spindle assembly comprising a spindle shaft rotatably mounted in two bearings mounted in a bearing tube arranged in a bearing housing having a rigid portion so that it can be clamped. First resilient means, e.g. circumferential slots in an intermediate tubular member, in the bearing housing, or a helical slot in the bearing-tube, to allow wobble of one of the bearings adjacent the drive of the spindle, and second resilient means, e.g. longitudinally-spaced webs in the intermediate member or the bearing housing to allow lateral displacement of the bearing adjacent the drive of the spindle in a direction perpendicularly to the axis of the rigid portion of the bearing housing.

11 Claims, 8 Drawing Figures

SPINNING SPINDLE ASSEMBLY

Figure 1:
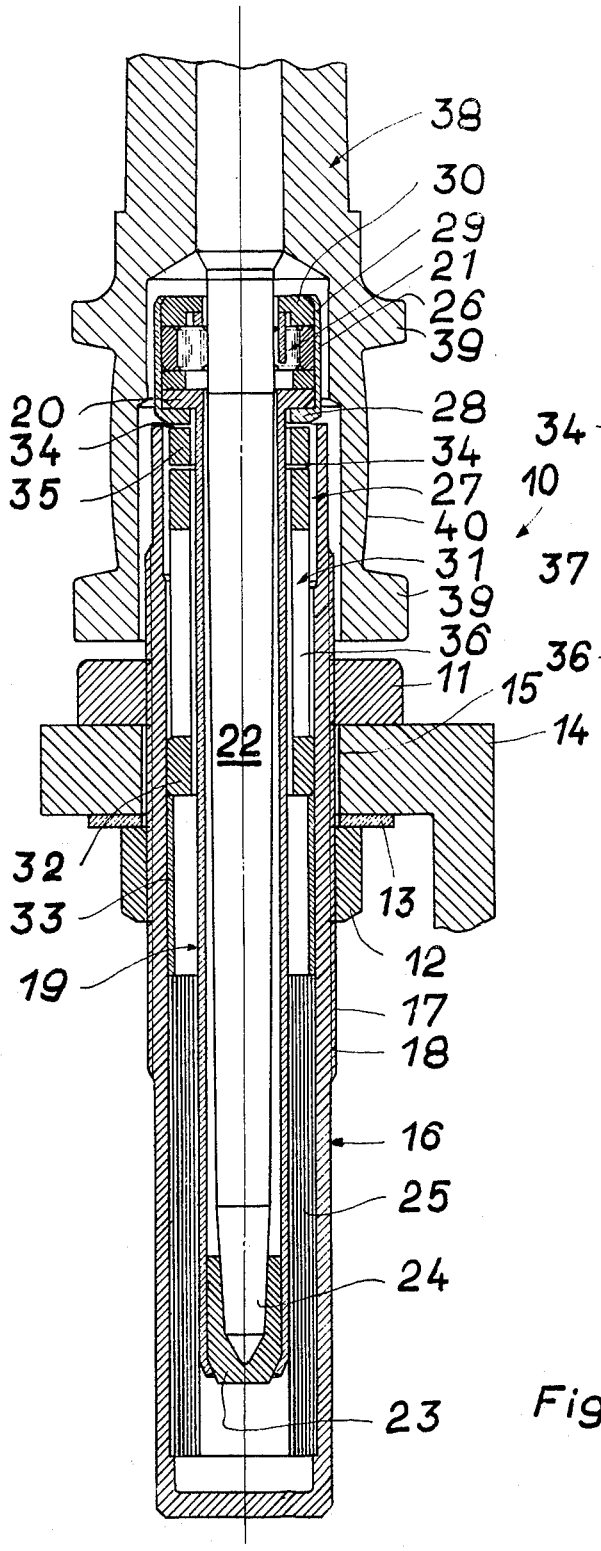

The present invention relates to a spinning or plying spindle.

Spinning or plying spindles are known having a spindle shaft, which is drivable by means of a driving pulley and rotatably mounted in a collar bearing at the same level as the driving pulley and in a pivot bearing. Both bearings are mounted in a bearing tube which in turn is arranged in a firmly chucked bearing housing, the bearing tube being connected to the bearing housing, so as to be able to wobble with respect to the bearing housing about a centre situated in the area of the collar bearing and against resilient action.

The "wobbly" mounting of the bearing tube enables the spindle shank, particularly at very high speeds, to be deflected so that the over-all centre of gravity of the rotating spindle approaches the axis of rotation of the spindle shaft and even coincides with it. The shank then carries out a wobbling motion about the axis of rotation of the rotating spindle. The axis of rotation of the rotating spindle and the axis of the spindle shaft intersect in the area of the collar bearing, this intersection forming the centre about which the bearing tube is able to wobble.

A successful construction of a spinning or plying spindle which has been known for a very long time and has these properties can be derived from e.g. Swiss Pat. No. 266,066. In another known construction which has similar properties, the bearing tube comprises, between the collar bearing and the pivot bearing, a section with a continuous, helical slot. With this construction the bearing tube firmly chucked in the bearing housing in the area of the collar bearing is thus itself flexurally elastic and the wobbling ability of the bearing tube is substantially dependent on the practically unavoidable radial clearance of the spindle shaft in the collar bearing and on the construction of the collar bearing itself. It has, however, been found that there are limits to the weight of spool supportable by the spindle and the rotational speed if prolonged operation of the spindle is required. In other words, it has been found that for avoiding the vibrations and noises which are detrimental to the spindle's life it is not sufficient to enable only the actual centre of gravity of the rotating system to move towards the axis of rotation. It has also been found that an increase of the spool weight and/or of the speed becomes possible when the construction of the spindle admits besides the wobbling or tilting movement of the axis of gravity of the rotating system, also a parallel displacement thereof so that in the supercritical speed range the axis of gravity of the rotating system can approach the axes of rotation and coincide therewith.

Endeavouring to provide such a construction it has, for example, already been proposed (e.g. Swiss Pat. No. 509,430 or German Pat. No. 1,025,767), to fix the bearing housing itself to the spindle chuck by means of an elastically yielding rubber sleeve or a lamellar spring with a spring body of elastomers.

In this construction, however, the higher degree of freedom of movement of the spindle shaft means that firm clamping of the bearing housing had to be abandoned. Furthermore, this construction is considerably more costly and requires much more space that the previously-mentioned spindles. Fitting into existing spindle chucks is thus only limitedly possible. The wobbly mounting of the bearing housing in the spindle chuck means that the whole bearing housing and with it the driving pulley, participates in the rotating movements so that not only an externally accessible component always carries out the undesirable, very quick rotating movements but also slip in drive transmission to the driving pulley will possibly be increased and become uncontrollable.

Other constructions have also been proposed which in principle permit a parallel displacement of the axis of the spindle shank. These constructions, however, have not succeeded in practice because the axis of the spindle shaft is tilted already under the action of the belt tension on the driving pulley so that with this construction the spindle has a strong tendency to swirl uncontrollably.

An object of the present invention is to provide a spindle in which the disadvantages of the known spindles are at least reduced.

The invention provides a spinning or plying spindle comprising a spindle shaft rotatably mounted in two bearings mounted in a bearing tube arranged in a bearing housing having at least one rigid portion whereby the bearing housing may be clamped, first resilient means allowing resilient tilting and hence wobble of one of the bearings and the bearing tube when the spindle is driven substantially adjacent the said one of the bearings, and second resilient means allowing lateral displacement of the said one of the bearings in a direction substantially at right angles to the longitudinal axis thereof, and to the said at least one rigid portion of the bearing housing.

Preferably, a tubular intermediate member is arranged between the bearing housing and the bearing tube with peripheral play therebetween, one portion of the intermediate member being radially fixed relative to the bearing housing, and another portion of the intermediate member axially-spaced from the said one portion and being fixed to the bearing tube adjacent the said one bearing, there being a plurality of circumferentially-spaced axially-extending slots in the intermediate members with elastically resilient webs therebetween and arranged between the said two portions of the intermediate member.

Preferably, a plurality of peripherally-extending slots are provided in the intermediate member between the longitudinally-extending slots and the said another portion of the intermediate member.

Alternatively, the bearing housing has a plurality of circumferentially-spaced axially-extending slots with elastically-resilient webs therebetween, the slots being arranged between the said at least one rigid portion and the said one of the bearings.

Figure 1A:
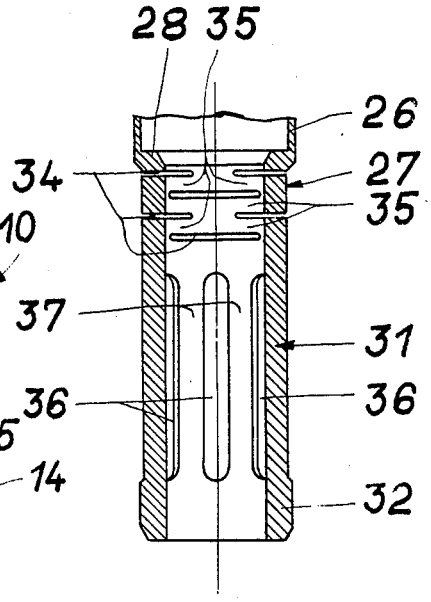
Figure 2:
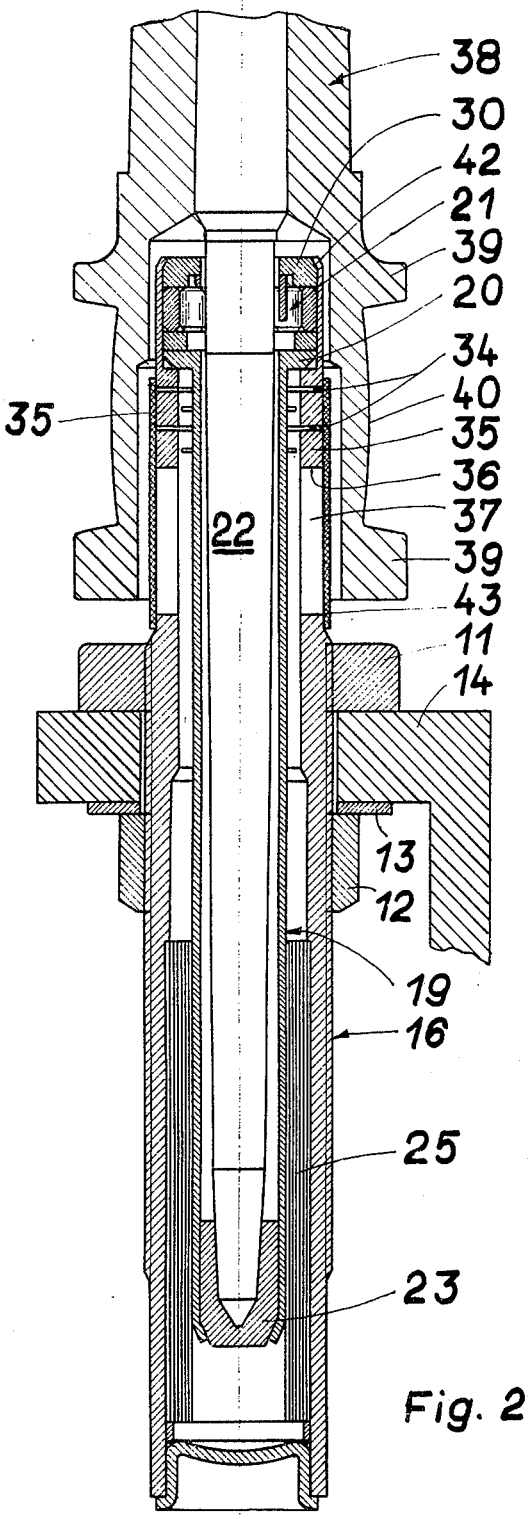
Figure 2A:
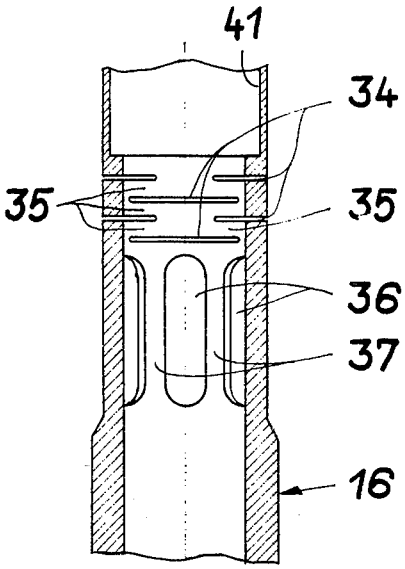
Figure 3:
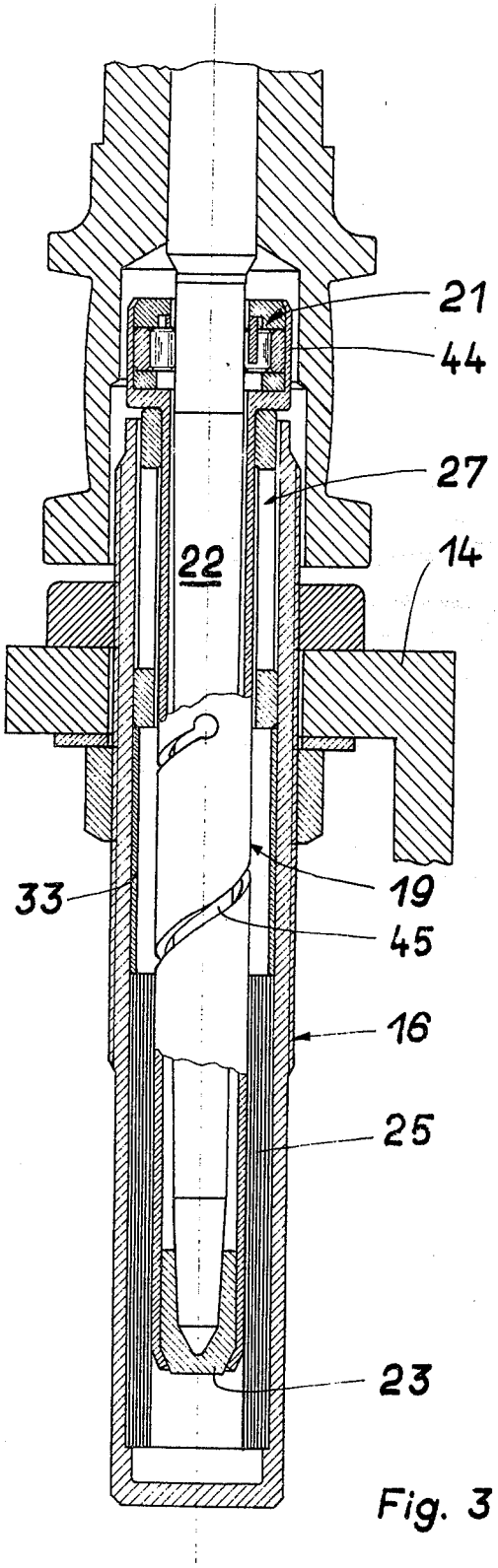
Figure 3A:
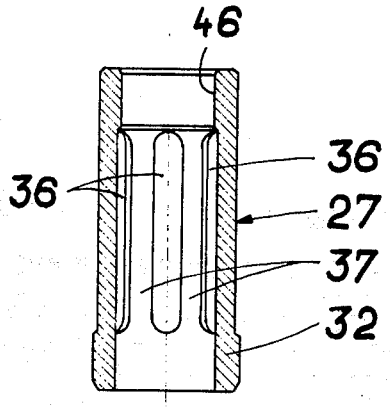
Figure 4:
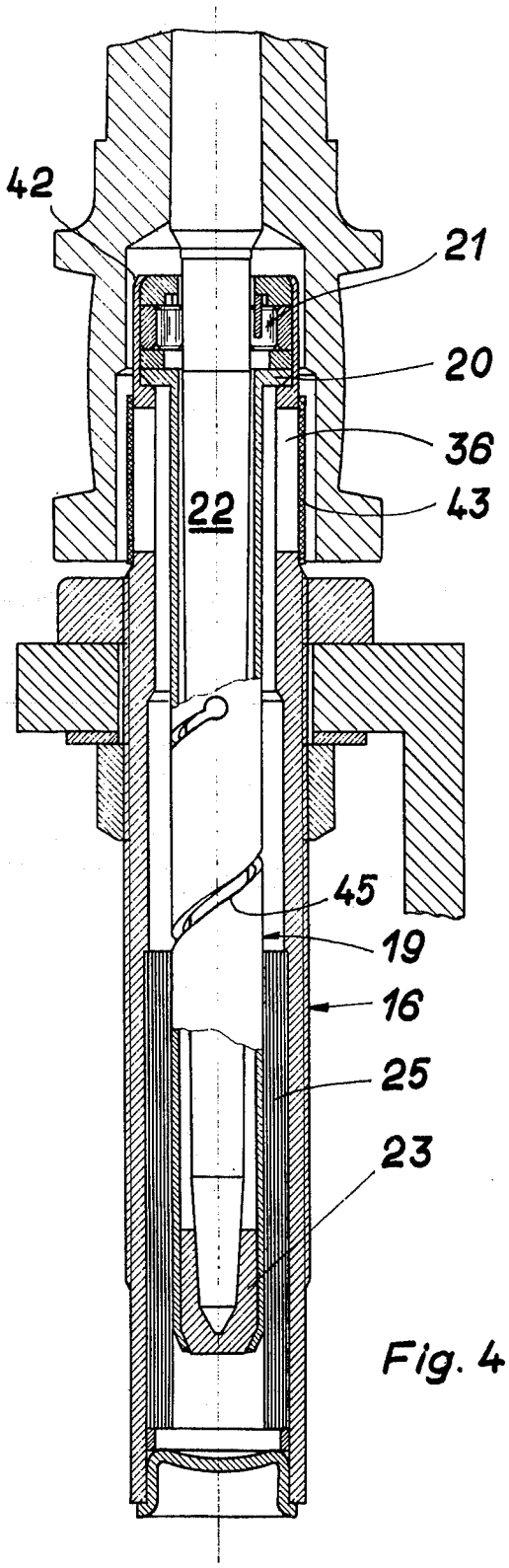
Figure 4A:
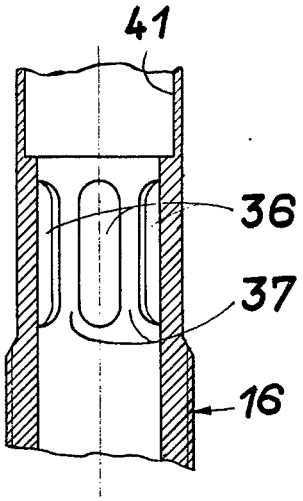

The invention will now be described with reference to embodiments shown by way of example in the accompanying drawings, wherein:

FIG. 1 is a longitudinal section through a part of a spinning spindle according to the invention, FIG. 1*a* is a section through a part of the intermediate member of the spinning spindle of FIG. 1, FIG. 2 is a longitudinal section through a second embodiment of a spinning spindle, FIG. 2*a* is a longitudinal section through a part of the bearing shell of the embodiment of FIG. 2, FIG. 3 is a longitudinal section through a further embodiment, FIG. 3*a* is a longitudinal section through a part of the intermediate member of the embodiment of FIG. 3, FIG. 4 is a longitudinal section through a fourth embodiment, and FIG. 4*a* is a longitudinal section through a part of the bearing shell of the embodiment of FIG. 4.

In FIGS. 1 and 1*a* a spinning spindle assembly 10 has a bearing housing or shell 16, which is firmly clamped by means of a nut 11, a lock nut 12 and a washer 13 in a bore 15 of a spindle chuck 14. The nut 11 and the lock nut 12 are screwed on an external screw thread 18 formed on a middle section 17 of the bearing shell 18. A bearing tube 19 extends into the bearing shell 16, which is closed at its lower end. A radially-projecting flange 20 is formed on the upper end of the bearing tube 19. The upper face of the flange 20 is a seating for a roller bearing 21, which forms a collar bearing for a spindle shank 22 extending in the bearing tube 19. A pivot or step bearing 23 shown diagrammatically in FIG. 1 is arranged in the lower end of the bearing tube 19 and supports the pointed end 24 of the spindle shank 22. The lower end of the bearing tube 19 is surrounded by a damping member in the form of a so-called damping spiral 25, which consists of a coiled leaf spring in which there is play between the individual coils, the innermost coil engaging flush against the bearing tube 19, and the outermost coil engaging flush against the inside of the bearing shell 16.

The component parts of the roller bearing 21 are firmly retained on the upper face of the flange 20 by a cup-shaped or tubular upper section 26 of an intermediate member 27. As can be seen from FIG. 1, the bottom 28 of the cup-shaped section 26 extends inwardly beneath the flange 20 of the bearing tube 19, whilst its upper edge 29 is tapered inwardly over an upper axial holding ring 30 of the roller bearing 21.

The intermediate member 27 has a middle section 31 (FIG. 1*a*), which adjoins the upper section 26 and surrounds the bearing tube 19, and extends with play into the bearing shell 16. The lower end of the middle section 31 of the intermediate member 27 has an outwardly-projecting shoulder 32 with which the intermediate member 27 is pressed or firmly screwed into the bearing shell 16. A spacer sleeve 33, which is arranged between the damping spiral 25 and the shoulder 32 and engages flush against the inside of the bearing shell 16, defines the axial position of the intermediate member 27 and thus also of the bearing tube 19, as well as of the bearing 21 and 23 with with respect to the bearing shell 16.

As is clearly apparent from FIG. 1*a*, close to to the bottom 28 of the upper section 26 of the intermediate member 27 there are a number of transverse slots 34 which extend in planes lying at right angles to the longitudinal axis of the intermediate member 27 and are staggered in the peripheral direction. These transverse slots impart to the upper section 26 of the intermediate member 27, and thus also to the bearing tube 19 as well as to the bearing 21 and 23 and the spindle shank 22, an ability to wobble or tilt with respect to the remaining section of the intermediate member 27 and thus also with respect to the bearing shell 16. However, a wobbling or deflection of the bearing tube 19 can only be effected by overcoming the elastic resilience of webs 35 between the slots 34. The webs 35 likewise extend in planes lying at right angles to the longitudinal axis of the intermediate member 27, and are thus flexurally stressed by a tilting movement of the spindle shank 22 with respect to the bearing shell 16.

Beneath the transverse slots 34, the middle section 31 of the intermediate members 27 has a number of uniformly-spaced longitudinally-extending peripheral slots 36 with webs 37 therebetween. These webs 37 form a kind of spatial parallelogram that allows a transverse displacement of the upper section 26 with respect to the collar 32 without a change of the direction of the axis of the upper section 26. Also this second transverse displacement can only be effected by overcoming the elastic resilience of the webs 37 which become flexurally stressed.

In conclusion it can thus be said that the upper section 26 of the intermediate member 27, and therefore also the bearing tube 19, the bearings 21, 23, as well as the spindle shank 22, can be deflected against the elastic resilience of the webs 35, in any desired direction with respect to the bearing shell 16 and about a centre situated in the area of the bearing 21. Deflection is also possible against the elastic resilience of the webs 37, in any desired direction at right angles to the spindle axis.

As is apparent from FIG. 1, a driving pulley member 38 having a curved pulley groove 40 which is bounded by flanges 39, is non-rotationally mounted on a portion of the spindle shank 22, which projects from the bearing tube 19. The pulley groove 40 surrounds the intermediate member 27 exactly adjacent the transverse slots 34, which allow tilting of the spindle shank 22. Hence when a lateral force is exerted on the driving pulley member 38 by a driving belt (not shown), this does not lead to a tilting of the spindle shank 22 because the centre about which said shank can be deflected is situated at the level of the pulley groove 40. Such a lateral force due to the belt tension merely leads to a transverse displacement of the spindle shank 22 with respect to the bearing shell 16 but the direction of the axis remains constant. To this transverse displacement is then to be added, in the movement of the spindle, the transverse displacement caused by imbalance and the bending of the spindle shank. The effect of the damping spiral obviously extends to all the deviations of the lower end of the bearing tube 19 away from the coaxial position of rest.

In the embodiment according to FIG. 2, the above-described properties of the spinning spindle are achieved without the aid of an intermediate member 27. The spindle shank 22 which is mounted in the collar bearing 21 and in the pivot bearing 23, is again shown. As in the embodiment of FIG. 1, the collar bearing 21 engages flush against the upper face of the upper cover flange of the bearing tube 19, the lower end of which is surrounded by the damping spiral 25. As is apparent from FIG. 2*a*, the upper end of the bearing shell 16 has a countersunk portion 41, which accommodates the bearing 21 and the flange 20. The uppermost edge 42 of the bearing shell is bent over the guard ring 30 of the bearing 21.

In this embodiment the transverse slots 34 and the webs 35 lying therebetween, which allow the bearing tube 19 to wobble with respect to the fixed portion of the bearing shell 16, are provided in the bearing shell 16 itself, i.e. immediately adjacent the countersunk portion 41 (FIG. 2*a*). Adjacent the area with the transverse slots 34, the bearing shell 16 has a number of continuous longitudinal slots 36 extending longitudinally of the bearing shell and comprising webs 37 lying therebetween. In this embodiment, the countersunk portion 41 has substantially the same degrees of freedom of movement as the upper section 26 of the intermediate member 27 of the embodiment according to FIG. 1. In the embodiment of FIG. 2, however, the slotted area of the bearing shell 16 is covered by a flexible sleeve 43, e.g. of rubber, in order to avoid any penetration by the threads, unavoidably flying around during spinning, into the interior of the bearing shell 16, which is normally filled with oil. It should be noted that in this case merely a sealing function and not e.g. a damping function is to be performed by the flexible sleeve 43. Consequently, the flexible sleeve may also consist of a flexible but not elastic plastics tube which is pulled over the upper half of the shell bearing 16.

The remainder of the embodiment of FIG. 2 is substantially the same as that of FIG. 1. In particular the bearings 21 and 23 remain in exact axial alignment with respect to each other notwithstanding the extent of the angular deflection and/or the transverse displacement of the bearing tube.

In the embodiment of FIG. 3 a different construction of the bearing tube 19 is used. A cup-shaped bearing housing 44 is formed at the upper end of the bearing tube 19 and houses the bearing 21. In addition, the bearing tube 19 has in its middle section a continuous, helical slot 45 which imparts a flexural elasticity to the bearing tube 19 in the manner of a helical spring. The lower end of the bearing tube 19 again carries the pivot bearing 24 and is surrounded by the damping spiral 25.

The upper end of the bearing tube 19 is supported in the embodiment according to FIG. 3 directly beneath the bearing housing 44 in the upper end of a tubular intermediate member 27. For this purpose, the intermediate member 27 (FIG. 3*a*) has at its upper end a cylindrical fitting portion 46 with which the intermediate member 27 is pulled over the bearing tube 19. Similarly to the embodiment according to FIG. 1, the intermediate member 27 has at its lower end a collar 32 with which the intermediate member in the bearing shell 16 is pressed or firmly screwed into the spindle chuck 14. Also in this embodiment the axial reference position of the intermediate member and thus of the bearing tube 19 with respect to the bearing shell 16 is determined by a spacer sleeve 33 which at one end is supported on the damping spiral 25 and at the other end supports the intermediate member 27. Since in the embodiment of FIG. 3 the wobbling ability of the spindle shank 22 is determined by the flexural elasticity of the bearing tube 19 itself, the intermediate member 27 has in this embodiment merely a number of longitudinal slots 36 with webs 37 lying therebetween. The mode of operation of the embodiment shown in FIG. 3 corresponds, however, substantially to the mode of operation of the embodiment of FIG. 1, with the exception that upon a wobbling motion of the spindle shank 22 the axis of the bearing 21 is no longer in alignment with the position of the pivot bearing 23. This, however, is irrelevant in most cases since the roller bearings practically always allow a certain wobbling motion. Furthermore, the pivot bearing 23, which is only shown diagrammatically, may be so designed that it permits a bending of the axis of the spindle shank 22 with respect to the axis of the bearing without jamming.

Finally, the embodiment of FIG. 4 can be considered as a combination of the embodiments of FIGS. 3 and 2. The bearing tube 19 is provided with the spiral slot 45, the lower end of the tube carrying the pivot bearing 23 and being surrounded by the damping spiral 25. On the upper end of the bearing tube 19, as in the embodiment of FIG. 2, merely the projecting flange 20 is provided, the upper face of which forms the seating for the collar bearing 21. In the upper end portion of the bearing shell 16, the recess or countersunk portion 41 is provided, the upper end edge of which is bent over the bearing 21, and thus presses it onto the seating of the flange 20. Since also here the wobbling ability of the spindle shank 22 is determined by the flexural elasticity of the bearing tube 19 itself, the bearing shell 16 is provided beneath the countersunk portion 41 merely with a number of longitudinal slots 36 with webs 37 lying therebetween. Also in this embodiment, as in that of FIG. 2, the longitudinal slots 36 are covered by the flexible sleeve 43.

In conclusion it can be said that with the above-described spinning and twisting spindles, besides an ability to wobble about a centre situated in the area of the collar bearing, the spindle shaft is also laterally displaceable, said displaceability being achieved, since the collar bearing is displaceable against elastic resilience at right angles to its axis in respect of the chucked section. Movements of the bearing shell itself, at least up to its chucked portion, are thereby avoided although a sufficient degree of freedom of movement is permitted to the spindle shank.

I claim:

1. A spinning spindle assembly comprising a bearing housing, a bearing tube arranged in said bearing housing, first and second spaced bearings mounted in said bearing tube, a spindle shaft rotatably mounted in said bearings, at least one rigid portion of the bearing housing whereby the bearing housing may be clamped, driven means on said spindle shaft and extending around said first bearing whereby the spindle may be driven substantially adjacent said first bearing, first resilient means as part of said spinning spindle assembly allowing resilient tilting and hence wobble of said first bearing and said bearing tube, damping means interposed between said bearing housing and said bearing tube for counteracting and damping the tilting and wobbling movement of said bearing tube, and second resilient means spaced from said first resilient means as part of said spinning spindle assembly allowing lateral displacement of said first bearing in a direction substantially at right angles to the longitudinal axes of said spindle shaft.

2. A spinning spindle assembly according to claim 1 further comprising a tubular intermediate member arranged between the bearing housing and the bearing tube with peripheral play therebetween, a first portion of said intermediate member being fixed radially relative to said bearing housing, a second portion of said intermediate member being axially-spaced from said first portion and being fixed to said bearing tube adjacent said first bearing, the intermediate member comprising a plurality of circumferentially-spaced, longitudinally extending web members defining circumferentially-spaced longitudinally-extending slots therebetween, said web members being elastically resilient and arranged between said first and second portions of said intermediate member.

3. A spinning spindle assembly according to claim 2, wherein said first portion of said intermediate member is arranged radially within said at least one rigid portion of said bearing housing, whereby both said portions may be clamped together.

4. A spinning spindle assembly according to claim 2, wherein said slots are at least as wide as said webs.

5. A spinning spindle assembly according to claim 2, further comprisisng a helical slot in said bearing tube between said first and second bearings.

6. A spinning spindle assembly according to claim 2 further comprising a plurality of peripherally-extending slots in said intermediate member between said longitudinally-extending slots and said second portion of said intermediate member.

7. A spinning spindle assembly according to claim 6, wherein said peripherally-extending slots are arranged in axially-spaced transverse planes, the slots of adjacent planes being staggered.

8. A spinning spindle assembly according to claim 1, wherein the bearing housing comprises a plurality of circumferentially-spaced axially-extending web members defining axially-extending slots therebetween, said web members being elastically resilient and arranged between said at least one rigid portion of the bearing housing and said first bearing.

9. A spinning spindle assembly according to claim 8, wherein the bearing housing further comprises a plurality of peripherally-extending slots between said longitudinally-extending slots and said first bearing.

10. A spinning spindle assembly according to claim 8, further comprising a helical slot in said bearing tube between said first and second bearings.

11. A spinning spindle assembly according to claim 8, further comprising a flexible sleeve on said bearing housing and covering said slots.

* * * * *